US005597686A

United States Patent [19]

MacIntyre et al.

[11] Patent Number: 5,597,686

[45] Date of Patent: Jan. 28, 1997

[54] PHOTOGRAPHIC SILVER HALIDE EMULSION CONTAINING CONTRAST IMPROVING DOPANTS

[75] Inventors: Gladys L. MacIntyre, Clyde; Eric L. Bell, Webster, both of N.Y.

[73] Assignee: Eastman Kodak Company, Rochester, N.Y.

[21] Appl. No.: 429,989

[22] Filed: Apr. 27, 1995

Related U.S. Application Data

[63] Continuation-in-part of Ser. No. 3,181, Jan. 12, 1993, abandoned.

[51] Int. Cl.[6] ..... G03C 1/09

[52] U.S. Cl. ..... 430/567; 430/604; 430/605

[58] Field of Search ..... 430/567, 604, 430/605

[56] References Cited

U.S. PATENT DOCUMENTS

| | | | |
|---|---|---|---|
| 2,717,833 | 9/1955 | Wark | 97/7 |
| 3,672,901 | 6/1972 | Ohkubo et al. | 96/94 |
| 3,901,713 | 8/1975 | Yamasue et al. | 96/95 |
| 4,126,472 | 11/1978 | Sakai et al. | 96/110 |
| 4,147,542 | 4/1979 | Habu et al. | 96/27 E |
| 4,828,962 | 5/1989 | Greskowiak et al. | 430/230 |
| 4,835,093 | 5/1989 | Janusonis et al. | 430/567 |
| 4,847,191 | 7/1989 | Greskowiak | 430/605 |
| 4,933,272 | 6/1990 | McDugle et al. | 430/567 |
| 4,937,180 | 6/1990 | Marchetti et al. | 430/567 |
| 4,945,035 | 7/1990 | Keevert et al. | 430/567 |
| 4,981,781 | 1/1991 | McDugle et al. | 430/605 |
| 5,002,866 | 3/1991 | Kashi | 430/567 |
| 5,132,203 | 7/1992 | Bell et al. | 430/567 |

FOREIGN PATENT DOCUMENTS

| | | |
|---|---|---|
| 0325235 | 7/1989 | European Pat. Off. . |
| 0423765 | 4/1991 | European Pat. Off. . |
| 0457298 | 11/1991 | European Pat. Off. . |
| 1/285941A | 11/1989 | Japan . |
| 2234151 | 9/1990 | Japan . |
| 3/276152A | 12/1991 | Japan . |
| 3/274542A | 12/1991 | Japan . |
| 4/056846A | 2/1992 | Japan . |
| 4-362931 | 12/1992 | Japan . |
| 554522 | 4/1977 | U.S.S.R. . |
| 1395923 | 5/1975 | United Kingdom . |
| 92/16876 | 10/1992 | WIPO . |

*Primary Examiner*—Mark F. Huff
*Attorney, Agent, or Firm*—Sarah Meeks Roberts

[57] ABSTRACT

The present invention provides a photographic emulsion comprising a silver halide grains containing at least two dopants. The dopants comprise an osmium-based transition metal complex containing a nitrosyl or thionitrosyl ligand, and a transition metal complex containing a transition metal selected from Group 8 of the periodic table.

19 Claims, No Drawings

PHOTOGRAPHIC SILVER HALIDE EMULSION CONTAINING CONTRAST IMPROVING DOPANTS

CROSS-REFERENCE TO RELATED APPLICATION

This is a continuation-in-part of application Ser. No. 08/003,181, filed Jan. 12, 1993, noe abandoned, entitled "Photographic Silver Halide Emulsion Containing Contrast Improving Dopants" by Gladys Louise MacIntyre.

FIELD OF THE INVENTION

This invention relates to photographic emulsions. In particular, it relates to photographic silver halide emulsions containing dopants and having improved contrast.

BACKGROUND OF THE INVENTION

In both color and black and white photography, there exists the desire for products which exhibit increased contrast upon exposure to light and subsequent development. This desire is based upon the realization that contrast is directly related to the appearance of sharpness; and, it follows, that products which exhibit increased contrast give the visual impression of enhanced sharpness.

Traditionally, photographers have defined contrast by two methods, both of which are derived from the D-log E curve (also known as the "characteristic curve"; see James, *The Theory of Photographic Properties,* 4th ed. pp 501–504). The first method is the determination of gamma ($\gamma$), which is defined as the slope of the straight-line section of the D-log E curve. The second is the determination of the overall sharpness of the toe section of the D-log E curve. By sharpness of the toe section, it is usually meant the relative density of the toe section. For instance, a sharp toe corresponds to a relatively low (small) toe density, and a soft toe corresponds to a relatively high (large) toe density. Generally, the point at which toe density is measured corresponds to 0.3 log E fast of the speed point, although toe density may properly be measured at any point prior to the curve's primary increase in slope. The speed point corresponds to the point on the D-log E curve where density equals 1.0.

If either the value of $\gamma$ is high or the toe is sharp, then the image has a relatively high contrast. If the value of $\gamma$ is low or the toe is soft, the image has a relatively low contrast.

It is known that in attempts to maximize the contrast of photographic elements based on silver halide emulsions (as well as other characteristics of the photographic element), the silver halide emulsions have been doped with various transition metal ions and compounds. Dopants are substances added to the emulsion during silver halide precipitation which become incorporated within the internal structure of the silver halide grains. Because they are internally incorporated, they are distinguished from substances added post-precipitation such as chemical or spectral sensitizers. These latter compounds are externally associated with the surface of the silver halide grains and are thus more properly referred to as addenda or grain surface modifiers.

Depending on the level and location of dopants, they may modify the photographic properties of the grains. When the dopants are transition metals which form a part of a coordination complex, such as a hexacoordination complex or a tetracoordination complex, the ligands can also be occluded within the grains, and they too may modify the grain's photographic properties.

Specific examples of doped silver halide emulsions can be found in U.S. Pat. No. 4,147,542, which discloses the use of iron complexes having cyanide ligands; U.S. Pat. Nos. 4,945,035 and 4,937,180 which disclose the use of hexacoordination complexes of rhenium, ruthenium and osmium with at least four cyanide ligands; and U.S. Pat. No. 4,828,962, which discloses the use of ruthenium and iridium ions to reduce high intensity reciprocity failure (HIRF).

Recently, emulsion dopants have been described which comprise transition metal complexes having nitrosyl or thionitrosyl ligands. European Patent Applications 0325235 and 0457298 disclose the use of one such complex, namely potassium ferric pentacyanonitrosyl. A second type of dopant, rhenium nitrosyl or rhenium thionitrosyl is disclosed in U.S. Pat. No. 4,835,093; and a third, dicesium pentachloronitrosyl osmate, is disclosed in U.S. Pat. No. 4,933,272.

It has also been known to use combinations of dopants in silver halide emulsions. Such combinations of dopants can be found in U.S. Pat. No. 3,901,713, which discloses the addition of both rhodium and iridium compounds during emulsification or the first ripening; and in U.S. Pat. No. 3,672,901, which teaches the combined use of iron compounds and iridium or rhodium salts.

Methods of improving the photographic characteristics of silver halide emulsions have also consisted of adding transition metals to the emulsions during chemical or spectral sensitization. As mentioned, transition metals added in this manner, because they are added subsequent to silver halide precipitation, are referred to as grain surface modifiers rather than dopants.

The most prevalent chemical sensitizers are the gold and sulfur sensitizers, both of which are thought to enhance emulsion speed by forming electron traps and/or photoholes on the silver halide crystal surface. Sensitization has also been accomplished by the addition of other transition metals. Specifically, platinum salts have been used, although sensitization with such salts is strongly retarded by gelatin. In addition, iridium salts and complex ions of rhodium, osmium, and ruthenium have been used as chemical sensitizers (and also as dopants). The overall effect of these metals on sensitivity appears to be dependent upon their valence state.

Although it is known to employ transition metals, and combinations thereof, as either dopants or grain surface modifiers, prior applications of such transition metals have yielded emulsions exhibiting inferior contrast improvement. This has often been the result of one dopant or grain surface modifier exerting an insufficient effect; or the result of a combination of dopants or grain surface modifiers exerting opposing effects.

Accordingly, it would be desirable to overcome these deficiencies by providing a high contrast silver halide emulsion exhibiting a high $\gamma$ and sharpened toe, wherein a combination of dopants imparts the high contrast characteristic.

SUMMARY OF THE INVENTION

The present invention provides a photographic silver halide emulsion comprising silver halide grains internally containing at least two dopants, wherein the first of said dopants is an osmium-based transition metal complex containing a nitrosyl or thionitrosyl ligand, and the second dopant is a transition metal complex containing a transition metal selected from Group 8 of the periodic table.

The dopants utilized in accordance with the present invention are added to the emulsion during the precipitation of the silver halide crystals. Thus, they are incorporated into the internal structure of the crystalline grains where they unexpectedly improve the contrast of the silver halide emulsion.

In one aspect of the invention, the dopants are incorporated into silver chloride grains that are substantially free of silver bromide or silver iodide. In another aspect, the emulsions contain a third transition metal as either a dopant or grain surface modifier.

In these instances, the emulsions containing the combination of dopants according to this invention exhibit improved contrast.

DETAILED DESCRIPTION OF THE INVENTION

The present invention is concerned with photographic emulsions comprising silver halide grains in which an osmium-based transition metal complex containing a nitrosyl ligand or a thionitrosyl ligand, and a transition metal complex containing a transition metal selected from Group 8 of the periodic table, serve as dopants which improve contrast by sharpening the emulsion's toe and increasing its γ. To exert their contrast improving effect, the dopants of the present invention must be incorporated into the internal structure of the silver halide grains. Thus, they should be added during precipitation. Incorporation should preferably be done until 93% of the grain volume is formed. However, the advantages of the invention are achieved even when the dopants are added at an earlier or later time, so long as the dopants are positioned below the surface of the silver halide grain.

The preferred osmium-based transition metal complexes which may be employed as dopants in accordance with the present invention can be generically defined by the formula:

$$[OsE_4(NZ)E']^r$$

where

Z is oxygen or sulfur, and together with nitrogen forms the nitrosyl or thionitrosyl ligand;

E and E' represent ligands additional to the nitrosyl or thionitrosyl ligand; and r is zero, −1, −2, or −3.

As part of the osmium-based dopant, the nitrosyl or thionitrosyl ligand is incorporated into the internal structure of the silver halide grain where it serves to modify the emulsion's photographic properties.

The additional ligands are also incorporated into the internal structure of the silver halide grains. The ligand defined above by E represents a bridging ligand which serves as a bridging group between two or more metal centers in the crystal grain. Specific examples of preferred bridging ligands include aquo ligands, halide ligands, cyanide ligands, cyanate ligands, thiocyanate ligands, selenocyanate ligands, tellurocyanate ligands, and azide ligands. The ligand defined above by E' represents either E, nitrosyl or thionitrosyl.

The preferred osmium-based transition metal complexes include:

| | |
|---|---|
| TMC-1 | $[Os(NO)Cl]^{-2}$ |
| TMC-2 | $[Os(NO)(CN)_5]^{-2}$ |
| TMC-3 | $[Os(NS)Br_5]^{-2}$ |
| TMC-4 | $[Os(NS)Cl_4(N_3)]^{-2}$ |
| TMC-5 | $[OS(NS)I_4(N_3)]^{-2}$ |
| TMC-6 | $[Os(NS)Br_4(CN)]^{-2}$ |
| TMC-7 | $[Os(NS)I_4(SCN)]^{-2}$ |
| TMC-8 | $[Os(NS)Br_4(SeCN)]^{-2}$ |
| TMC-9 | $[Os(NS)Cl_3(N_3)_2]^{-2}$ |
| TMC-10 | $[Os(NS)Cl_3(SCN)_2]^{-2}$ |
| TMC-11 | $[Os(NS)Br_2(SCN)_3]^{-2}$ |
| TMC-12 | $[Os(NS)I_2(CN)_3]^{-2}$ |
| TMC-13 | $[Os(NS)Cl_2(SeCN)_3]^{-2}$ |

-continued

| | |
|---|---|
| TMC-14 | $[Os(NS)Cl_2(N_3)_4]^{-2}$ |
| TMC-15 | $[Os(NS)Cl(SeCN)_4]^{-2}$ |
| TMC-16 | $[Os(NS)(SeCN)_5]^{-2}$ |

The most preferred osmium-based transition metal complex is $[Os(NO)Cl_5]^{-2}$; and prior to its incorporation into a silver halide grain, it is associated with a cation, typically $2Cs^{+1}$.

The Group 8 transition metals suitable in the second dopant are defined according to the format of the periodic table adopted by the American Chemical Society and published in the *Chemical and Engineering News*, Feb. 4, 1985, p.26. Thus, these transition metals comprise iron, ruthenium and osmium. Preferably, the Group 8 transition metals are associated with cyanide ligands. More preferably, they are in the form of anions characterized by the formula:

$$[M(CN)_{6-y}L_y]^n$$

wherein

M is defined as a Group 8 transition metal;

L is a bridging ligand which serves as a bridging group between two or more metal centers in the crystal grain (Preferably it is a halide, azide, or thiocyanate, although any ligand capable of functioning in a bridging capacity is also specifically contemplated.);

y is zero, 1, 2, or 3; and n is −2, −3,or −4.

Preferred examples of compounds incorporating Group 8 transition metals of the claimed invention include:

| | |
|---|---|
| TMC-17 | $[Ru(CN)_6]^{-4}$ |
| TMC-18 | $[Os(CN)_6]^{-4}$ |
| TMC-19 | $[Fe(CN)_6]^{-4}$ |
| TMC-20 | $[RuF(CN)_5]^{-4}$ |
| TMC-21 | $[OsF(CN)_5]^{-4}$ |
| TMC-22 | $[FeF(CN)_5]^{-4}$ |
| TMC-23 | $[RuCl(CN)_5]^{-4}$ |
| TMC-24 | $[OsCl(CN)_5]^{-4}$ |
| TMC-25 | $[FeCl(CN)_5]^{-4}$ |
| TMC-26 | $[RuBr(CN)_5]^{-4}$ |
| TMC-27 | $[OsBr(CN)_5]^{-4}$ |
| TMC-28 | $[FeBr(CN)_5]^{-4}$ |
| TMC-29 | $[RuI(CN)_5]^{-4}$ |
| TMC-30 | $[OsI(CN)_5]^{-4}$ |
| TMC-31 | $[FeI(CN)_5]^{-4}$ |
| TMC-32 | $[RuF_2(CN)_4]^{-4}$ |
| TMC-33 | $[OsF_2(CN)_4]^{-4}$ |
| TMC-34 | $[FeF_2(CN)_4]^{-4}$ |
| TMC-35 | $[RuCl_2(CN)_4]^{-4}$ |
| TMC-36 | $[OsCl_2(CN)_4]^{-4}$ |
| TMC-37 | $[FeCl_2(CN)_4]^{-4}$ |
| TMC-38 | $[RuBr_2(CN)_4]^{-4}$ |
| TMC-39 | $[OsBr_2(CN)_4]^{-4}$ |
| TMC-40 | $[FeBr_2(CN)_4]^{-4}$ |
| TMC-41 | $[RUI_2(CN)_4]^{-4}$ |
| TMC-42 | $[OsI_2(CN)_4]^{-4}$ |
| TMC-43 | $[FeI_2(CN)_4]^{-4}$ |
| TMC-44 | $[Ru(CN)_5(OCN)]^{-4}$ |
| TMC-45 | $[Os(CN)_5(OCN)]^{-4}$ |
| TMC-46 | $[Fe(CN)_5(OCN)]^{-4}$ |
| TMC-47 | $[Ru(CN)_5(SCN)]^{-4}$ |
| TMC-48 | $[Os(CN)_5(SCN)]^{-4}$ |
| TMC-49 | $[Fe(CN)_5(SCN)]^{-4}$ |
| TMC-50 | $[Ru(CN)_5(N_3)]^{-4}$ |
| TMC-51 | $[OS(CN)_5(N_3)]^{-4}$ |
| TMC-52 | $[Fe(CN)_5(N_3)]^{-4}$ |
| TMC-53 | $[Ru(CN)_5(H_2O)]^{-3}$ |
| TMC-54 | $[Os(CN)_5(H_2O)]^{-3}$ |
| TMC-55 | $[Fe(CN)_5(H_2O)]^{-3}$ |
| TMC-56 | $[Ru(SCN)_6]^{-4}$ |
| TMC-57 | $[Os(SCN)_6]^{-4}$ |

-continued

| | |
|---|---|
| TMC-58 | $[Fe(SCN)_6]^{-4}$ |
| TMC-59 | $[Ru(OCN)_6]^{-4}$ |
| TMC-60 | $[Os(OCN)_6]^{-4}$ |
| TMC-61 | $[Fe(OCN)_6]^{-4}$ |

Most preferred are $[Fe(CN)_6]^{-4}$ and $[Ru(CN)_6]^{-4}$; and prior to incorporation, both are associated with an appropriate cation, typically $4K^{+1}$. $[Fe(CN)_6]^{-4}$ is also typically associated with three waters of crystallization (hydration).

When $[Os(NO)Cl_5]^{-2}$ is incorporated into a photographic emulsion in an amount between about $7.5\times10^{-10}$ moles per mole of silver halide and about $4.5\times10^{-9}$ moles per mole of silver halide; and $[Fe(CN)_6]^{-4}$ or $[Ru(CN)_6]^{-4}$ are incorporated in an amount between about $5.0\times10^{-6}$ moles per mole of silver halide and about $2.0\times10^{-5}$ moles per mole of silver halide, optimum contrast improvement is achieved. To obtain both improved contrast and a minimization of the dopants' impact on latent image keeping, it is contemplated to use an amount of the $[Fe(CN)_6]^{-4}$ or $[Ru(CN)\ 6]^{-4}$ dopant less than the range previously specified. Specifically, an amount of dopant between about $1.0\times10^{-9}$ and about $5.0\times10^{-6}$ moles per silver halide mole is contemplated. More preferred is an amount between about $5.0\times10^{-8}$ and about $5.0\times10^{-6}$ moles per silver halide mole.

In the preferred embodiment of the invention, an additional transition metal may be added to the emulsion as either a third dopant or as a grain surface modifier. This can be done without significantly detracting from effects of the other emulsion dopants. The additional transition metal is preferably added after precipitation so that it is incorporated onto the surfaces of the silver halide grains. However, it may also be added during silver halide precipitation so that it is banded from 93 percent to 95.5 percent of the grain volumes at a level between about $4.1\times10^{-8}$ and $3.1\times10^{-7}$ moles per mole of silver halide. By banding, it is meant that the additional transition metal is added to the emulsion after 93 percent of the silver halide has precipitated, and until 95.5 percent of the silver halide has precipitated. It is most preferred that this third transition metal be iridium, which may be in the form of an anion.

Silver halide grains in photographic emulsions can be formed of bromide ions as the sole halide, chloride ions as the sole halide, or any mixture of the two. It is also common practice to incorporate minor amounts of iodide ions in photographic silver halide grains.

In photographic emulsions, iodide concentrations in silver halide grains seldom exceed 20 mole percent and are typically less than 10 mole percent, based on silver. However, specific applications differ widely in their use of iodide. In high speed (ASA 100 or greater) camera films, silver bromoiodide emulsions are employed since the presence of iodide allows higher speeds to be realized at any given level of granularity. In radiography, silver bromide emulsions or silver bromoiodide emulsions containing less than 5 mole percent iodide are customarily employed. Emulsions employed for the graphic arts and color paper, by contrast, typically contain greater than 50 mole percent chloride. Preferably they contain greater than 70 mole percent, and optimally greater than 85 mole percent, chloride. The remaining halide in such emulsions is preferably less than 5 mole percent, and optimally less than 2 mole percent, iodide, with any balance of halide not accounted for by chloride or iodide being bromide.

The advantages of the invention would be present in any of the above-mentioned types of emulsions, although it is preferred that the emulsions comprise silver chloride grains which are substantially free of silver iodide and silver bromide. By substantially free, it is meant that such grains are greater than about 90 molar percent silver chloride. Preferably, silver chloride accounts for greater than about 99 molar percent of the silver halide in the emulsion. Optimally, silver chloride is the sole halide.

Moreover, the invention may be practiced in black-and-white or color films utilizing any other type of silver halide grains. The grains may be conventional in form such as cubic, octahedral, dodecahedral, or octadecahedral, or they may have an irregular form such as spherical grains or tabular grains. Further, the grains of the present invention may be of the type having <100>, <111>, or other known orientation, planes on their outermost surfaces.

The invention may further be practiced with any of the known techniques for emulsion preparation, specific examples of which are referenced in the patents discussed in *Research Disclosure*, December 1989, 308119, Sections I–IV at pages 993–1000. Such techniques include those which are normally utilized, for instance single jet or double jet precipitation; or they may include forming a silver halide emulsion by the nucleation of silver halide grains in a separate mixer or first container with later growth in a second container. Regardless of which method is used, the dopants of the invention should be added during silver halide precipitation so that they are internally incorporated into the silver halide grains.

After formation of the silver halide grains, the emulsions containing the grains are washed to remove excess salt. They may then be chemically or spectrally sensitized by any conventional agent, and in any conventional manner, as disclosed in the above-referenced *Research Disclosure* 308119.

Sensitizing dyes which can be used in accordance with the invention include the polymethine dye class, which further includes the cyanines, merocyanines, complex cyanines and merocyanines (i.e. tri-, tetra- and polynuclear cyanines and merocyanines), oxonols, hemioxonols, styryls, merostyryls, and streptocyanines. Specific dyes include 3,3'-diethyl-9,11-trimethylene-thiacarbocyanine iodide, anhydro-3-ethyl-9,11-neopentylene-3'-(3-sulfopropyl)thiadicarbocyanine hydroxide, anhydro-9-ethyl-5,5'-diphenyl-3,3'-di(2-sulfoethyl)oxacarbocyanine hydroxide triethylammonium salt, anhydro-5-chloro-5'-phenyl-3,3'-bis(3-sulfopropyl)oxathiacyanine hydroxide triethylammonium salt, and anhydro-5-chloro-5'-pyrolylthiazolothiacyanine hydroxide tetrabutylammonium salt. Other dyes which can be used are disclosed *Research Disclosure* 308119.

Chemical sensitizers which can be used in accordance with the invention include the gold and sulfur class sensitizers, such as aurous sulfide, aurous bis(1,4,5-trimethyl-1,2,4-triazolium-3-thiolate)tetra-fluoroborate, and sodium thiosulfate, or the transition metal sensitizers as discussed above. Further, they can be combined with any of the known antifoggants or stabilizers such as those disclosed in *Research Disclosure* 308119, Section VI. These may include halide ions, chloropalladates, and chloropalladites. Moreover, they may include thiosulfonates, quaternary ammonium salts, tellurazolines, and water soluble inorganic salts of transition metals such as magnesium, calcium, cadmium, cobalt, manganese, and zinc.

After sensitizing, the emulsions can be combined with any suitable coupler (whether two or four equivalent) and/or coupler dispersants to make the desired color film or print photographic materials; or they can be used in black-and-white photographic films and print material. Couplers which can be used in accordance with the invention are described in *Research Disclosure* Vol. 176, 1978, Section 17643 VIII and *Research Disclosure* 308119 Section VII, the entire disclosures of which are incorporated by reference.

The emulsions of the invention may further be incorporated into a photographic element and processed, upon exposure, by any known method (such as those methods disclosed in U.S. Pat. No. 3,822,129). Typically, a color photographic element comprises a support, which can contain film or paper sized by any known sizing method, and at least three different color forming emulsion layers. The element also typically contains additional layers, such as filter layers, interlayers, overcoat layers, subbing layers, and the like. It may contain brighteners, antistain agents, hardeners, plasticizers and lubricants, as well as matting agents and development modifiers. Specific examples of each of these, and their manners of and sodium thiosulfate, application, are disclosed in the above-referenced *Research Disclosure* 308119, and *Research Disclosure* 17643.

The invention can be better appreciated by reference to the following specific examples. They are intended to be illustrative and not exhaustive of the emulsions of the present invention and their methods of formation.

EXAMPLES

Preferred sensitizing dyes, and those used in accordance with the examples below, are illustrated by the following structures:

SENSITIZING DYE A:

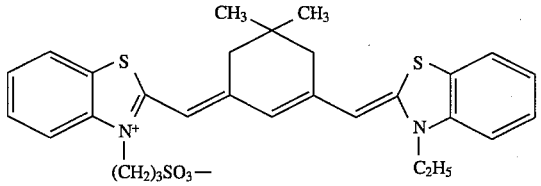

DYE B:

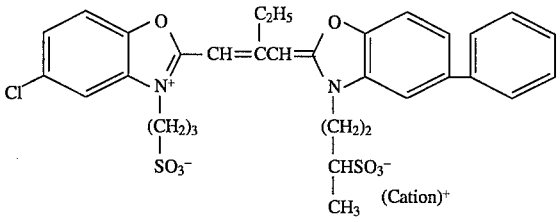

DYE C:

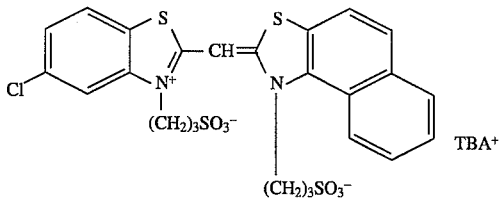

The following examples also incorporated the addition of antifoggants and stabilizers into the emulsion making process. The specific antifoggants and stabilizers used are represented by the structures below:

COMPOUND 1:

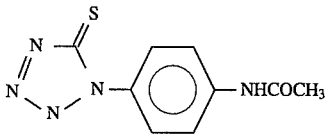

-continued

COMPOUND 2:

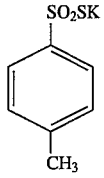

COMPOUND 3:

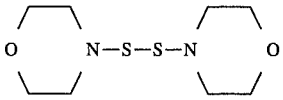

COMPOUND 4:

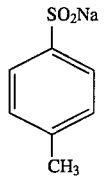

Preferred image dye couplers, and those used in accordance with the following examples have the following structures:

COUPLER A:

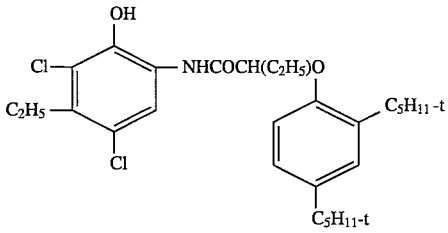

COUPLER B:

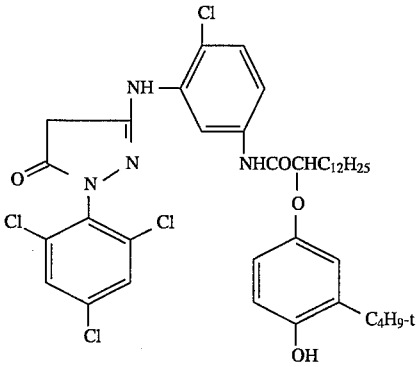

COUPLER C:

-continued

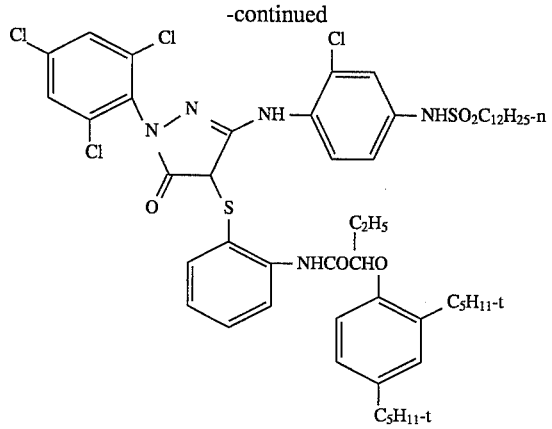

COUPLER D:

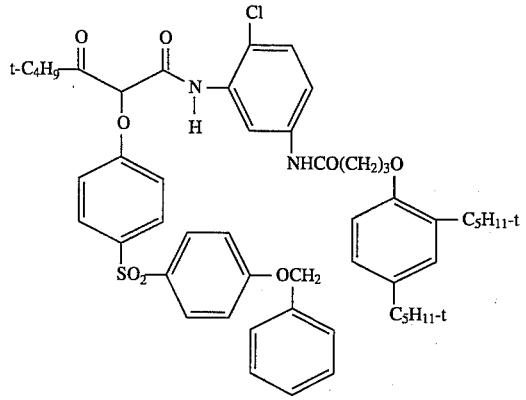

| Preparation of the emulsions | |
|---|---|
| Emulsion preparation for examples 1–25 Solutions utilized for emulsion preparation: | |
| Solution A | |
| Gelatin | 21.0 g |
| 1,8-dithiooctanediol | 112.5 mg |
| Water | 532.0 ml |
| Solution B | |
| Silver Nitrate | 170.0 g |
| Water | 467.8 ml |
| Solution C | |
| Sodium Chloride | 58.0 g |
| Water | 480.0 ml |
| Solution D | |
| Sodium Chloride | 53.9 g |
| $Cs_2Os(NO)Cl_5$ | 1.5 mg |
| Water | 446.4 ml |
| Solution E | |
| Sodium Chloride | 53.9 g |
| $K_4Fe(CN)_6$ | 4.22 mg |
| Water | 446.4 ml |

Emulsion 1 was prepared by placing solution A in a reaction vessel and stirring at 46° C. Solutions B and C were added simultaneously at constant flow rates of 0.05 moles/min while controlling the silver potential at 1.5 pCl. The emulsion was then washed to remove excess salts. The emulsion grains were cubic and had an edge length of 0.372 microns.

Emulsion 2 was prepared by placing solution A in a reaction vessel and stirring at a temperature of 46° C. Solutions B and E were added simultaneously at constant flow rates for 93% of the grain volume. The silver potential was controlled at 1.5 pCl. After 93% of the grain volume was achieved, solution C was used in place of solution E for the remainder of the reaction. The emulsion was washed to remove excess salts. The grains were cubic with an edge length of 0.358 microns.

Emulsion 3 was prepared in a manner similar to emulsion 2 except that the amount of $K_4Fe(CN)_6$ was increased in solution E to 8.44 milligrams. The cubic edge length of emulsion 3 was 0.327 microns.

Emulsion 4 was prepared in a manner similar to emulsion 2 except that solution D was used in place of solution E. The cubic edge length of this emulsion was 0.342 microns.

Emulsion 5 was prepared in a manner similar to emulsion 4 except that the amount of $Cs_2Os(NO)Cl_5$ was increased to 3.0 micrograms. The emulsion had a cubic edge length of 0.361 microns.

Emulsion 6 was prepared by decreasing the amount of water in solutions D and E to 223.2 ml. Solution A was placed in a reaction vessel and stirred at 46° C. Solutions D and E were then run in simultaneously with solution B at constant flow rates for 93% of the grain volume. The silver potential was controlled at 1.5 pCl. After 93% of the grain volume was achieved, solution C replaced solutions D and E for the remainder of the precipitation. The emulsion was then washed to remove excess salts. The emulsion was cubic with an edge length of 0.335 microns.

Emulsion 7 was prepared in a manner similar to emulsion 6 except that the amount of $K_4Fe(CN)_6$ was increased in solution E to 8.44 milligrams. The cubic edge length of emulsion 7 was 0.351 microns.

Emulsion 8 was prepared in a manner similar to emulsion 6 except that the amount of $Cs_2Os(NO)Cl_5$ was increased to 3.0 micrograms. The emulsion had a cubic edge length of 0.336 microns.

Emulsion 9 was prepared in a manner similar to emulsion 8 except that the amount of $K_4Fe(CN)_6$ was increased in solution E to 8.44 milligrams. The cubic edge length of emulsion 9 was 0.345 microns.

The above emulsions are described in Table I.

TABLE I

| Emulsion | $K_4Fe(CN)_6$ (milligrams) | $Cs_2Os(NO)Cl_5$ (micrograms) | Edge length (microns) |
|---|---|---|---|
| 1 control | 0 | 0 | 0.372 |
| 2 control | 4.22 | 0 | 0.358 |
| 3 control | 8.44 | 0 | 0.327 |
| 4 control | 0 | 1.5 | 0.342 |
| 5 control | 0 | 3.0 | 0.361 |
| 6 invention | 4.22 | 1.5 | 0.335 |
| 7 invention | 8.44 | 1.5 | 0.351 |
| 8 invention | 4.22 | 3.0 | 0.336 |
| 9 invention | 8.44 | 3.0 | 0.345 |

Examples 1–9

Each of the emulsions described above was heated to 40° C. To each emulsion, 17.8 milligrams of a gold sensitizing compound as disclosed in U.S. Pat. No. 2,642,361 was added. The emulsions were then digested at 65° C. In addition, 297 milligrams of Compound 1 and 1306 milligrams KBr was added along with 20 mg sensitizing dye A.

The emulsions were coated on a paper support at 183 mg/m$^2$ silver along with 448 mg/m$^2$ cyan dye forming coupler A. A 1076 mg/m$^2$ gel overcoat was applied as a protective layer along with a vinylsulfone hardener. The coatings were exposed for 0.1 second with a Wratten™ WR12 filter through a step tablet and were processed at 35° C. as follows:

| | |
|---|---|
| Color development | 45 sec |
| Bleach-fix (FeEDTA) | 45 sec |
| Wash | 90 sec |
| Developer composition: | |
| Water | 800 ml |
| Triethanolamine 100% | 11 ml |
| Lithium Polystyrene Sulfonate 30% | 0.25 ml |
| Potassium Sulfite, 45% | 0.5 ml |
| N,N-Diethylhydroxylamine 85% | 6 ml |
| PHORWITE REUä | 2.3 g |
| Lithium Sulfate | 2.7 g |
| 1-Hydroxyethyl-1,1-diphosphoric acid 60% | 0.8 ml |
| Potassium Chloride | 1.8 g |
| Potassium Bromide | 0.02 g |
| Methanesulfonamide,N-(2-((4-amino-3-methylphenyl)ethylamino)ethyl)-, sulfate (2:3) | 4.55 g |
| Potassium Carbonate | 23 g |
| Water to make | 1.0 ltr |
| pH | 10.12 |

The results are shown in Table IIA and correspond to sensitometric data points on each emulsion's D-log E curve. To assist in understanding these results, and hence the invention, particular attention is drawn to Examples 1, 3, 5, and 9. Example corresponds to an emulsion having no dopants. Its toe value is 0.352 and its gamma is 2.763. When a single dopant is added to this emulsion, as in Examples 3 or 5, toe value and gamma are changed. If 8.44 milligrams of $K_4Fe(CN)_6$ per mole of silver halide are added (Example 3), contrast decreases as toe softens (larger value) and gamma decreases. If, on the other hand, 3.0 micrograms of $Cs_2Os(NO)Cl_5$ are added to the emulsion instead of $K_4Fe(CN)_6$ (Example 5), contrast increases as toe sharpens (smaller value) and gamma increases.

The invention resides in an emulsion containing the combination of dopants. As can be seen from Example 9, such an emulsion exhibits a very large contrast increase. Toe density, for instance, is much sharper with the combination of dopants than with either dopant alone, or even additive effects of each dopant. Similarly, gamma is much higher with the combination of dopants.

This analysis may be used to understand the remaining results in Table IIA, as well as the results in the following Examples. Further understanding of the invention may be garnered by reference to the columns labeled "% Toe change". The values in these columns correspond to the change in toe from an undoped emulsion (i.e., Example 1). For Table IIA, doping with only $K_4Fe(CN)_6$ results in a positive toe change (softening); and doping with only $Cs_2Os(NO)Cl_5$ results in a negative toe change (sharpening). Doping with a combination of these two dopants, by contrast, results in a very large negative toe change (sharpening).

TABLE IIA

| Example | Dopants Fe[1] | Dopants $Os(NO)_2$ | Speed[3] | 0.3Toe[4] | Gamma[5] | % Toe change |
|---|---|---|---|---|---|---|
| 1 control | 0 | 0 | 138 | 0.352 | 2.763 | — |

TABLE IIA-continued

| Example | Dopants Fe[1] | Dopants $Os(NO)_2$ | Speed[3] | 0.3Toe[4] | Gamma[5] | % Toe change |
|---|---|---|---|---|---|---|
| 2 control | 4.22 | 0 | 152 | 0.353 | 2.753 | +0.3% |
| 3 control | 8.44 | 0 | 143 | 0.375 | 2.686 | +6.5% |
| 4 control | 0 | 1.5 | 133 | 0.347 | 2.776 | −1.4% |
| 5 control | 0 | 3.0 | 133 | 0.305 | 2.915 | −13.4% |
| 6 invention | 4.22 | 1.5 | 132 | 0.318 | 2.900 | −9.7% |
| 7 invention | 8.44 | 1.5 | 137 | 0.306 | 2.929 | −13.4% |
| 8 invention | 4.22 | 3.0 | 131 | 0.283 | 2.709 | −19.6% |
| 9 invention | 8.44 | 3.0 | 129 | 0.248 | 3.139 | −30.5% |

[1]milligrams $K_4Fe(CN)_6$/mole silver halide; $Fe(CN)_6^{-4}$ incorporated throughout 93.0% of the grain (by volume)
[2]micrograms $Cs_2Os(NO)Cl_5$/mole silver halide; $Os(NO)Cl_5^{-2}$ incorporated throughout 93% of the grain (by volume)
[3]The reciprocal of the relative amount of light in LogE × 100 to produce 1.0 density.
[4]The density value of the point 0.3 log E fast of the speed point.
[5]The slope of the line between a point 0.3 log E fast of the speed point and a point 0.3 Log E slow of the speed point.

The effect of a third transition metal, iridium, on the activity of the dopants is illustrated by adding to the emulsions corresponding to Examples 1–9, post-precipitation, 0.05 mgs $K_3IrCl_6$, and processing such emulsions as stated above. The results are set out below in Table IIB. They indicate that the effect of the combination of dopants remains even in the presence of a third transition metal.

TABLE IIB

| Example | Dopants Fe[1] | Dopants $Os(NO)_2$ | Speed[3] | 0.3Toe[4] | Gamma[5] | % Toe change |
|---|---|---|---|---|---|---|
| 1' control | 0 | 0 | 139 | 0.354 | 2.668 | — |
| 2' control | 4.22 | 0 | 143 | 0.364 | 2.640 | +2.8% |
| 3' control | 8.44 | 0 | 134 | 0.382 | 2.392 | +7.9% |
| 4' control | 0 | 1.5 | 127 | 0.357 | 2.591 | +0.8% |
| 5' control | 0 | 3.0 | 128 | 0.298 | 2.858 | −15.8% |
| 6' invention | 4.22 | 1.5 | 128 | 0.313 | 2.718 | −11.6% |
| 7' invention | 8.44 | 1.5 | 131 | 0.308 | 2.853 | −13.0% |
| 8' invention | 4.22 | 3.0 | 121 | 0.263 | 2.907 | −25.7% |
| 9' invention | 8.44 | 3.0 | 127 | 0.247 | 3.004 | −30.2% |

[1]milligrams $K_4Fe(CN)_6$/mole silver halide; $Fe(CN)_6^{-4}$ incorporated throughout 93.0% of the grain (by volume)
[2]micrograms $Cs_2Os(NO)Cl_5$/mole silver halide; $Os(NO)Cl_5^{-2}$ incorporated throughout 93% of the grain (by volume)
[3]The reciprocal of the relative amount of light in LogE × 100 to produce 1.0 density.
[4]The density value of the point 0.3 log E fast of the speed point.
[5]The slope of the line between a point 0.3 log E fast of the speed point and a point 0.3 Log E slow of the speed point.

Examples 10–21

Emulsions 1, 5 and 9 as described in Table I were chemically sensitized by adding 330 mg sensitizing dye B per mole silver and 22 mg of a gold sensitizing compound per mole silver, as described in U.S. Pat. No. 2,642,361. The emulsions were then digested at 70°. After digestion, compounds 1, 2 or 3, or combinations thereof, were added to the emulsions. When compounds 2 or 3 were used, they were always combined with compound 4 in a 1:10 ratio. Compound 1 was added at 380 mg/mole, compound 2 at 400 mg/mole and compound 3 at 240 mg/mole. KBr was added to the emulsions at 612 mg/mole. The emulsions were coated at 280 mg/m$^2$ silver along with 448 mg/m$^2$ magenta dye forming coupler B, or at 172 mg/m$^2$ with 350 mg/m$^2$ of magenta dye forming coupler C. The emulsion plus dye forming coupler was coated on a paper support that had been sized using conventional sizing methods or a paper support prepared according to the special procedure described in U.S. Pat. No. 4,994,147. The results after a 0.1 second exposure and the aforementioned process are listed in Table III below and show that the effect on toe sharpening due to the combination of dopants in the emulsion exists under a wide variety of coating preparation conditions.

Solution A was placed in a reaction vessel and stirred at 68.3° C. To produce emulsion 10, solutions B and C were added simultaneously with flow rates increasing from 0.193 moles/minute to 0.332 moles/minute. The silver potential was controlled at 1.5 pCl. The emulsion was then washed to remove excess salts. The cubic emulsion grains had an edge length of 0.784 microns.

Emulsion 11 was prepared in a manner similar to emulsion 10 except that solution D was used for 93% of the grain volume. After 93% of the grain volume had been achieved, solution C was used for the remainder of the precipitation. The cubic edge length of this emulsion was 0.780 microns.

Emulsion 12 was prepared in a manner similar to emulsion 11 except that solution E was used in place of solution D. The emulsion grains were cubic and had an edge length of 0.788 microns.

Emulsion 13 was prepared by decreasing the amount of water in both solutions D and E to 112.8 ml, mixing the two solutions together and using this solution for 93% of the grain volume as described for emulsion 11. After 93% of the grain volume, solution C was used for the remainder of the precipitation. The cubic emulsion grains had an edge length of 0.774 microns.

The above emulsions are listed in Table IV.

TABLE III

| | | | | EMULSION[3] 1 | | EMULSION[4] 5 | | | EMULSION[5] 9 | | |
|---|---|---|---|---|---|---|---|---|---|---|---|
| Example | Support | Coupler | Antifoggant | Speed[(1)] | Toe[(2)] | Speed[(1)] | Toe[(2)] | % Toe Change | Speed[(1)] | Toe[(2)] | % Toe Change |
| 10 | conventional | B | 1 | 133 | 0.345 | 124 | 0.295 | −15.5 | 116 | 0.227 | −34.2 |
| 11 | " | B | 1 + (2 + 4) | 134 | 0.340 | 123 | 0.295 | -13.2 | 116 | 0.230 | −32.4 |
| 12 | " | B | 1 + (3 + 4) | 134 | 0.345 | 123 | 0.296 | -14.2 | 116 | 0.227 | −34.2 |
| 13 | " | C | 1 | 134 | 0.380 | 124 | 0.337 | −11.3 | 117 | 0.260 | −31.6 |
| 14 | " | C | 1 + (2 + 4) | 133 | 0.381 | 124 | 0.330 | -13.4 | 117 | 0.258 | −32.1 |
| 15 | " | C | 1 + (3 + 4) | 134 | 0.380 | 123 | 0.337 | -11.3 | 117 | 0.264 | −30.5 |
| 16 | special procedure | B | 1 | 134 | 0.326 | 123 | 0.287 | −12.0 | 114 | 0.218 | −33.1 |
| 17 | " | B | 1 + (2 + 4) | 134 | 0.324 | 122 | 0.291 | -10.2 | 114 | 0.220 | −32.1 |
| 18 | " | B | 1 + (3 + 4) | 134 | 0.330 | 122 | 0.291 | -11.8 | 114 | 0.224 | −32.1 |
| 19 | " | C | 1 | 135 | 0.386 | 123 | 0.340 | −11.9 | 116 | 0.256 | −33.7 |
| 20 | " | C | 1 + (2 + 4) | 134 | 0.378 | 123 | 0,328 | -13.2 | 115 | 0.258 | −31.7 |
| 21 | " | C | 1 + (3 + 4) | 135 | 0.384 | 123 | 0.337 | -12.2 | 116 | 0.257 | −33.1 |

[1]The reciprocal of the relative amount of light in LogE × 100 to produce 1.0 density
[2]The density value of the point 0.3 logE fast of the speed point
[3]Emulsion 1 contained no $K_4Fe(CN)_6$ and no $Cs_2Os(NO)Cl_5$ (control)
[4]Emulsion 5 contained no $K_4Fe(CN)_6$ and 3.0 micrograms of $Cs_2Os(NO)Cl_5$ (control)
[5]Emulsion 9 contained 8.44 milligrams of $K_4Fe(CN)_6$ and 3.0 micrograms of $Cs_2Os(NO)Cl_5$ (invention)

Emulsion Preparation for examples 22–29

| | |
|---|---|
| Solution A | |
| Gelatin | 20.1 g |
| 1,8-dithiooctanediol | 190.0 mg |
| Water | 715.5 ml |
| Solution B | |
| Silver Nitrate | 170.0 g |
| Water | 230.3 ml |
| Solution C | |
| Sodium Chloride | 58.0 g |
| Water | 242.6 ml |
| Solution D | |
| Sodium Chloride | 53.9 g |
| $Cs_2Os(NO)Cl_5$ | 0.5 mg |
| Water | 225.6 ml |
| Solution E | |
| Sodium Chloride | 53.9 g |
| $K_4Fe(CN)_6$ | 2.11 mg |
| Water | 225.6 ml |

TABLE IV

| Emulsion | $K_4Fe(CN)_6$ mg/mol AgX | $Cs_2Os(NO)Cl_5$ μm/mol AgX | edge length (microns) |
|---|---|---|---|
| 10 control | none | none | 0.784 |
| 11 control | none | 0.5 | 0.780 |
| 12 control | 2.11 | none | 0.788 |
| 13 invention | 2.11 | 0.5 | 0.774 |

Examples 22–29

The above emulsions were melted at 40° C. To each emulsion a gold sensitizing compound as described in U.S. Pat. No. 2,642,361 was added. The emulsions were heated and digested at 60° C. To each emulsion, 280 mg of dye C was added, along with 104 mg of compound 1 and 547 mg of potassium bromide. These emulsions were used in examples 22–25. Examples 26–29 were prepared the same way except that 0.15 milligrams of $K_3IrCl_6$ were added to each emulsion subsequent to the addition of compound 1. The emulsions were coated at 280 mg/m$^2$ silver along with 1076 mg/m$^2$ of yellow dye forming coupler D on a paper support prepared by conventional sizing methods. The coated material was exposed for 0.1 second or 100 seconds and processed as in the previous examples. The results are shown in Table V below. These data illustrate that improved contrast due to the combination of dopants is found in the presence of a third transition metal, namely iridium, and that this advantage is present even at long exposure times.

TABLE V

| | | | | | 0.1 sec exposure | | | |
|---|---|---|---|---|---|---|---|---|
| Example | Emulsion | $Cs_2Os(NO)Cl_5$ μg/mole | $K_4Fe(CN)_6$ mg/mole | $K_3IrCl_6$ mg/mole | Speed[1] | Toe[2] | Gamma[3] | % Toe Change |
| 22 | 10 control | none | none | none | 104 | 0.345 | 2.652 | — |
| 23 | 11 control | 0.5 | none | " | 117 | 0.363 | 2.473 | +5.2 |
| 24 | 12 control | none | 2.11 | " | 131 | 0.327 | 2.501 | −5.2 |
| 25 | 13 invention | 0.5 | 2.11 | " | 128 | 0.229 | 2.764 | −33.6 |
| 26 | 10 control | none | none | 0.14 | 111 | 0.347 | 2.662 | — |
| 27 | 11 control | 0.5 | none | " | 120 | 0.345 | 2.536 | −0.3 |
| 28 | 12 control | none | 2.11 | " | 141 | 0.302 | 2.550 | −13.0 |
| 29 | 13 invention | 0.5 | 2.11 | " | 133 | 0.218 | 2.837 | −37.2 |
| | | | | | 100 sec exposure | | | |
| Example | Emulsion | $Cs_2Os(NO)Cl_5$ mg/mole | $K_4Fe(CN)_6$ mg/mole | $K_3IrCl_6$ mg/mole | Speed[1] | Toe[2] | Gamma[3] | % Toe Change |
| 22 | 10 control | none | none | none | 122 | 0.240 | 2.953 | — |
| 23 | 11 control | 0.5 | none | " | 129 | 0.2444 | 2.960 | +0.2 |
| 24 | 12 control | none | 2.11 | " | 138 | 0.280 | 2.902 | +16.7 |
| 25 | 13 invention | 0.5 | 2.11 | " | 131 | 0.153 | 3.362 | −36.3 |
| 26 | 10 control | none | none | 0.15 | 124 | 0.239 | 3.126 | — |
| 27 | 11 control | 0.5 | none | " | 130 | 0.240 | 3.112 | +0.1 |
| 28 | 12 control | none | 2.11 | " | 143 | 0.295 | 3.039 | +23.4 |
| 29 | 13 invention | 0.5 | 2.11 | " | 133 | 0.169 | 3.399 | −29.3 |

[1]The reciprocal of the relative amount of light in LogE × 100 to produce 1.0 density
[2]The density value of the point 0.3 logE fast of the speed point
[3]The slope of the line between a point 0.3 log E fast of the speed point and a point 0.3 logE slow of the speed point

Examples 30–49

A series of emulsions were prepared according to the procedures used for preparing Emulsions 10–13, except that the dopants were incorporated throughout 0–25% (core), 25–75% (band) or 75%–98% (band) of the volume of the silver halide grains, and the dopant levels were increased to 1.5 μg of $Cs_2Os(NO)Cl_5$ per mole silver chloride and 4.22 mg of $K_4Fe(CN)_6$ per mole silver chloride.

The emulsions were sensitized, coated, exposed, processed and tested as described for Examples 22–25. The sensitometric results are shown in Table VI below, where Speed, Toe, Gamma and % Toe Change are as shown in Table V.

TABLE VI

| | | Location | | (0.1 sec exposure) | | | |
|---|---|---|---|---|---|---|---|
| Example | Emulsion | $Cs_2Os(NO)Cl_5$ | $K_4Fe(CN)_6$ | Speed | Toe | Gamma | % Toe Change |
| 30 | control | — | — | 160 | 0.386 | 2.86 | — |
| 31 | " | 0–25% | — | 148 | 0.398 | 3.03 | +3.1 |
| 32 | " | — | 0–25% | 175 | 0.390 | 2.71 | +1.0 |
| 33 | invention | 0–25% | 0–25% | 132 | 0.216 | 5.33 | −44.0 |
| 34 | control | — | — | 160 | 0.386 | 2.86 | — |
| 35 | " | 0–25% | — | 148 | 0.398 | 3.03 | +3.1 |
| 36 | " | — | 75–98% | 180 | 0.400 | 2.70 | +3.6 |
| 37 | invention | 0–25% | 75–98% | 140 | 0.269 | 4.32 | −30.3 |
| 38 | control | — | — | 160 | 0.386 | 2.86 | — |
| 39 | " | 25–75% | — | 163 | 0.377 | 3.03 | −2.3 |
| 40 | " | — | 25–75% | 176 | 0.394 | 2.79 | +2.1 |
| 41 | invention | 25–75% | 25–75% | 139 | 0.221 | 4.74 | −42.8 |
| 42 | control | — | — | 160 | 0.386 | 2.86 | — |
| 43 | " | 75–98% | — | 158 | 0.358 | 3.05 | −7.5 |
| 44 | " | — | 0–25% | 175 | 0.390 | 2.71 | +1.0 |
| 45 | invention | 75–98% | 0–25% | 147 | 0.51 | 3.10 | −9.1 |

TABLE VI-continued

| Example | Emulsion | Location | | (0.1 sec exposure) | | | |
|---|---|---|---|---|---|---|---|
| | | $Cs_2Os(NO)Cl_5$ | $K_4Fe(CN)_6$ | Speed | Toe | Gamma | % Toe Change |
| 46 | control | — | — | 160 | 0.386 | 2.86 | — |
| 47 | " | 75–98% | — | 158 | 0.368 | 3.08 | −7.3 |
| 48 | " | — | 75–98% | 180 | 0.40 | 2.70 | +3.6 |
| 49 | invention | 75–98% | 75–98% | 159 | 0.305 | 3.63 | −21.0 |

The data from Table VI demonstrates that the advantages of the present invention are obtained when the dopants are incorporated at different locations within the silver halide grains.

Emulsion Preparation for Examples 50–55

Emulsions were prepared similar to those described for examples 22–29, except that the amount of $K_4Fe(CN)_6$ was kept constant and the amount of the $Cs_2Os(NO)Cl_5$ was varied from 0 to 2 micrograms/mole. Additional emulsions were prepared by varying the amount of $Cs_2Os(NO)Cl_5$ over the same range, and substituting $K_4Ru(CN)_6$ for the $K_4Fe(CN)_6$ at a level of 2.07 milligrams/mole. The emulsions are described below in Table VII.

TABLE VII

| Emulsion | $Cs_2Os(NO)Cl_5$ (μg/mole) | $K_4Fe(CN)_6$ (mg/mole) | $K_4Ru(CN)_6$ (mg/mole) |
|---|---|---|---|
| 14 control | none | 2.11 | none |
| 15 invention | 1 | 2.11 | " |
| 16 invention | 2 | 2.11 | " |
| 17 control | none | none | 2.07 |
| 18 invention | 1 | " | 2.07 |
| 19 invention | 2 | " | 2.07 |

Examples 50–55

Emulsions 14–19 were finished, coated, exposed and processed in a manner similar to examples 22–25. The sensitometric results are given in Table VIII and show that the increased toe sharpening according to the present invention can be obtained with $K_4Ru(CN)_6$ in place of $K_4Fe(CN)_6$.

TABLE VIIII

| Example | Emulsion | Speed[1] | Toe[2] |
|---|---|---|---|
| 50 | 14 | 153 | 0.316 |
| 51 | 15 | 151 | 0.232 |
| 52 | 16 | 134 | 0.155 |
| 53 | 17 | 154 | 0.269 |
| 54 | 18 | 146 | 0.142 |
| 55 | 19 | 127 | 0.132 |

[1]The reciprocal of the relative amount of light in Log E × 100 to produce a density of 1.0
[2]The density of a point 0.3 Log E faster than the speed point

Examples 56–63

In the following examples, as set forth in Table IX, the ability of the present invention's combination of dopants to improve contrast without deleteriously impacting an emulsion's stability is shown.

The emulsions for Examples 56–63 were prepared according to the procedures used for preparing Emulsions 10–13, except that the $Cs_2Os(NO)Cl_5$ dopant was incorporated throughout 0–70% of the volume of the silver halide grains, and the $K_4Ru(CN)_6$ dopant was incorporated throughout 75–93% of the volume of the silver halide grains. Also, the levels of dopants utilized were as described in Table IX, measured in terms of moles per mole of silver halide. The emulsions were sensitized, coated, and tested as described for Examples 22–25. LIK was taken as a measure of the emulsion's latent image stability. Specifically, it was measured as the speed change resulting from a delay of 24 hours from time of exposure to processing. Speed, Toe, and Gamma were as shown in Table V.

TABLE IX

| Example | $Cs_2Os(NO)Cl_5$ | $K_4Ru(CN)_6$ | Speed | Toe | Gamma | LIK |
|---|---|---|---|---|---|---|
| 56 | — | — | 160 | 0.39 | 2.7 | 0 |
| 57 | $3.9 \times 10^{-9}$ | — | 130 | 0.30 | 3.4 | 0 |
| 58 | $3.9 \times 10^{-9}$ | $3.8 \times 10^{-5}$ | 120 | 0.13 | 6.9 | 2 |
| 59 | $3.9 \times 10^{-9}$ | $3.8 \times 10^{-6}$ | 117 | 0.14 | 6.3 | 2 |
| 60 | $3.9 \times 10^{-9}$ | $1.2 \times 10^{-6}$ | 125 | 0.18 | 5.0 | 1 |
| 61 | $3.9 \times 10^{-9}$ | $3.8 \times 10^{-7}$ | 125 | 0.25 | 4.2 | 0 |
| 62 | $3.9 \times 10^{-9}$ | $1.2 \times 10^{-7}$ | 132 | 0.29 | 3.6 | 0 |
| 63 | $3.9 \times 10^{-9}$ | $3.8 \times 10^{-8}$ | 133 | 0.30 | 3.5 | 0 |

The invention has been described in detail with particular reference to preferred embodiments thereof but it will be understood that variations and modifications can be effected within the spirit and scope of the invention.

What is claimed is:

1. A photographic silver halide emulsion comprising silver halide grains internally containing at least two dopants, wherein the first of said dopants is an osmium-based transition metal complex containing a nitrosyl or thionitrosyl ligand, and the second dopant is a transition metal complex containing a transition metal selected from Group 8 of the periodic table.

2. A photographic emulsion according to claim 1 wherein said silver halide grains contain silver chloride and are substantially free of silver bromide or silver iodide.

3. A photographic emulsion according to claim 1 wherein said second dopant is associated with cyanide ligands.

4. A photographic emulsion according to claim 3 wherein said second dopant is in the form of an anion of the formula:

$$[M(CN)_{6-y}L_y]^n$$

wherein

M is a Group 8 transition metal;

L is a bridging ligand;

y is zero, 1, 2, or 3; and n is −2, −3, or −4.

5. A photographic emulsion according to claim 4 wherein said second dopant is in the form of $[Fe(CN)_6]^{-4}$.

6. A photographic emulsion according to claim 5 wherein $[Fe(CN)_6]^{-4}$ is incorporated into said silver halide grains in an amount between about $1.0\times10^{-9}$ moles per mole of silver halide and about $2.0\times10^{-5}$ moles per mole of silver halide.

7. A photographic emulsion according to claim 4 wherein said second dopant is in the form of $[Ru(CN)_6]^{-4}$.

8. A photographic emulsion according to claim 7 wherein $[Ru(CN)_6]^{-4}$ is incorporated into said silver halide grains in an amount between about $1.0\times10^{-9}$ moles per mole of silver halide and about $2.0\times10^{-5}$ moles per mole of silver halide.

9. A photographic emulsion according to claims 1 or 4 wherein said first dopant is of the formula:

$$[OsE_4(NZ)E']^r$$

wherein

Z is oxygen or sulfur, and together with nitrogen forms the nitrosyl or thionitrosyl ligand;

E and E' represent ligands; and r is zero, −1, −2, or −3.

10. A photographic emulsion according to claim 9 wherein said first dopant is $[Os(NO)Cl_5]^{-2}$.

11. A photographic emulsion according to claim 10 wherein $[Os(NO)Cl_5]^{-2}$ is incorporated into said silver halide grains in an amount between about $7.5\times10^{-10}$ moles per mole of silver halide and about $4.5\times10^{-9}$ moles per mole of silver halide.

12. A photographic emulsion according to claim 1 wherein the dopants are incorporated throughout 93 percent of the volume of said silver halide grains.

13. A photographic emulsion according to claim 1 wherein said silver halide grains further comprise a third transition metal.

14. A photographic emulsion according to claim 13 wherein said third transition metal is a grain surface modifier.

15. A photographic emulsion according to claim 13 wherein said third transition metal is banded from 93 percent to 95.5 percent of the silver halide grain volume.

16. A photographic emulsion according to claim 13 wherein said third transition metal is iridium.

17. A photographic emulsion according to claim 13 wherein said third transition metal is in an amount between about $4.1\times10^{-8}$ and about $3.1\times10^{-7}$ moles per mole of silver halide.

18. A photographic silver halide emulsion comprising substantially silver iodide and silver bromide free silver chloride grains, said silver chloride grains internally containing at least two dopants wherein said dopants comprise an osmium complex having nitrosyl or thionitrosyl ligands, and a transition metal complex containing a transition metal selected from the group consisting of iron and ruthenium.

19. A photographic silver halide emulsion having silver halide grains formed in the presence of a combination of dopants, said dopants being transition metal complexes and comprising osmium with a nitrosyl or thionitrosyl ligand, and a Group 8 metal with a cyanide ligand.

* * * * *